US009995290B2

(12) United States Patent
Pollard et al.

(10) Patent No.: US 9,995,290 B2
(45) Date of Patent: Jun. 12, 2018

(54) CRYOGENIC PUMP WITH INSULATING ARRANGEMENT

(71) Applicant: Caterpillar Inc., Peoria, IL (US)

(72) Inventors: Michael J. Pollard, Peoria, IL (US); Cory A. Brown, Peoria, IL (US); Alan R. Stockner, Metamora, IL (US); Adrienne M. Brasche, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 557 days.

(21) Appl. No.: 14/551,891

(22) Filed: Nov. 24, 2014

(65) Prior Publication Data

US 2016/0146199 A1 May 26, 2016

(51) Int. Cl.

| | |
|---|---|
| ***F17C 13/00*** | (2006.01) |
| ***F04B 15/08*** | (2006.01) |
| *F04B 15/06* | (2006.01) |
| *F04B 19/06* | (2006.01) |
| *F04B 53/16* | (2006.01) |
| *F04B 27/10* | (2006.01) |
| *F04B 39/12* | (2006.01) |

(Continued)

(52) U.S. Cl.

CPC ..... *F04B 15/08* (2013.01); *F04B 15/06* (2013.01); *F04B 19/06* (2013.01); *F04B 27/1081* (2013.01); *F04B 39/06* (2013.01); *F04B 39/068* (2013.01); *F04B 39/12* (2013.01); *F04B 39/121* (2013.01); *F04B 39/122* (2013.01); *F04B 39/123* (2013.01); *F04B 39/125* (2013.01); *F04B 39/127* (2013.01); *F04B 39/14* (2013.01); *F04B 53/16* (2013.01); *F04B 53/164* (2013.01); *F04B 2015/081* (2013.01)

(58) Field of Classification Search

CPC .... F04B 15/08; F04B 19/06; F04B 2015/081; F04B 27/1081; F04B 53/16; F04B 15/06; F04B 53/164; F04B 19/04; F04B 35/01; F04B 37/10; F04B 39/06; F04B 39/12; F04B 39/14; F04B 39/068; F04B 39/121; F04B 39/122; F04B 39/123; F04B 39/125; F04B 39/127; F04B 53/08

See application file for complete search history.

(56) References Cited

U.S. PATENT DOCUMENTS

| | | | |
|---|---|---|---|
| 2,054,710 | A | 9/1936 | Okada |
| 2,575,394 | A | 11/1951 | Rice |
| 3,251,602 | A | 5/1966 | Williams et al. |

(Continued)

FOREIGN PATENT DOCUMENTS

| | | | |
|---|---|---|---|
| DE | 10356734 | A1 | 7/2005 |

*Primary Examiner* — Keith Raymond
*Assistant Examiner* — Webeshet Mengesha
(74) *Attorney, Agent, or Firm* — Leydig, Voit & Mayer, LTD.; John Wappel

(57) ABSTRACT

A cryogenic pump configured for pressurizing a cryogenic fluid is provided. The cryogenic pump includes a warm end portion adapted to not contact cryogenic fluid during operation of the pump and including one or more driving components. The cryogenic pump includes a cold end portion adapted to contact cryogenic fluid during operation of the pump and including a pump inlet and a pump outlet. An insulating arrangement including an insulator plate is arranged between the warm end portion and the cold end portion and defines a first air gap between the cold end portion and the insulator plate.

10 Claims, 3 Drawing Sheets

(51) Int. Cl.
*F04B 39/06* (2006.01)
*F04B 39/14* (2006.01)

(56) References Cited

U.S. PATENT DOCUMENTS

| | | | | |
|---|---|---|---|---|
| 3,738,118 | A | 6/1973 | Jacobs | |
| 4,282,716 | A | 8/1981 | Momose et al. | |
| 4,576,557 | A | 3/1986 | Pevzner | |
| 5,884,488 | A | 3/1999 | Gram et al. | |
| 7,293,418 | B2 | 11/2007 | Noble et al. | |
| 8,403,627 | B2 * | 3/2013 | Hartmann | F04D 29/5893 415/101 |
| 2005/0169787 | A1 * | 8/2005 | Iguchi | F04B 27/1081 418/55.5 |
| 2005/0186087 | A1 * | 8/2005 | Koide | F04B 27/1009 417/269 |
| 2006/0101817 | A1 | 5/2006 | Fukutomi et al. | |
| 2013/0183173 | A1 * | 7/2013 | Kohli | F04B 35/045 417/410.1 |
| 2013/0259713 | A1 * | 10/2013 | Hayashi | F04B 27/1036 417/222.1 |
| 2014/0053800 | A1 | 2/2014 | Steffen et al. | |

* cited by examiner

CRYOGENIC PUMP WITH INSULATING ARRANGEMENT

TECHNICAL FIELD

The present disclosure relates generally to cryogenic pumps and, more particularly, to an insulating arrangement for a cryogenic pump.

BACKGROUND

Some applications require the handling, and more particularly the pumping, of cryogenic liquids. For example, heavy machines like locomotives or large mining trucks may have engines that use more than one fuel. The engine may be a dual fuel engine system, in which a gaseous fuel, such as compressed natural gas, is injected into a cylinder at high pressure while combustion in the cylinder from a diesel pilot is already underway. With such engines, the gaseous fuel is stored in a liquid state at a low pressure, such as atmospheric pressure, and at low, cryogenic temperatures in a storage tank in order to achieve a higher storage density. However, the use of such a cryogenic fuel requires the use of specialized equipment, including a cryogenic tank for storing the liquefied natural gas ("LNG") fuel and a cryogenic pump for withdrawing and pressurizing the liquefied natural gas fuel.

The cryogenic pumps used in these types of applications may be configured with a cold end and a warm end. The cold end is generally the end at which fluid is pumped and, as such, comes into contact with the cryogenic fluid. The warm end of the cryogenic pump generally contains many of the pump driving elements and may be exposed to atmospheric temperatures. Heat transfer from the warm end of the pump to the cold end can adversely impact the efficiency of a cryogenic pump. Accordingly, arrangements have been developed that insulate the warm end of the pump from the cold end. Such insulating arrangements also help prevent excessive heat transfer from the warm end of the pump allowing less expensive conventional materials to be used at the warm end while materials rated for cryogenic service may be used at the cold end.

U.S. Pat. No. 4,576,557 ("the '557 patent") discloses one example of an insulating arrangement for thermally insulating a pumping section of a cryogenic pump from the driving section of the pump. More specifically, the '557 patent discloses surrounding the entire pumping section of the pump with an insulation space that is bounded on its sides by plates and is filled with a low conductivity material, such as perlite.

The arrangement disclosed in the '557 patent as well as other similar arrangements using low thermal conductivity materials to insulate the cold and warm ends of a cryogenic pump from each other suffer from several drawbacks. For example, such materials are often not robust enough in terms of their mechanical properties for use in many pumping applications. Additionally, such materials can be relatively expensive.

SUMMARY

In one aspect, the present disclosure describes a cryogenic pump configured for pressurizing a cryogenic fluid. The cryogenic pump includes a warm end portion adapted to not contact cryogenic fluid during operation of the pump and including one or more driving components. The cryogenic pump also includes a cold end portion adapted to contact cryogenic fluid during operation of the pump and including a pump inlet and a pump outlet. An insulating arrangement including an insulator plate is arranged between the warm end portion and the cold end portion and defines a first air gap between the cold end portion and the insulator plate.

In another aspect, the present disclosure describes a cryogenic pump configured for pressurizing a cryogenic fluid. The cryogenic pump includes a warm end portion adapted to not contact cryogenic fluid during operation of the pump. The warm end portion including a shaft and a load plate for driving movement of a plurality of pushrods, at least a portion of the plurality of pushrods being contained in a pushrod housing. The cryogenic pump includes a cold end portion adapted to contact cryogenic fluid during operation of the pump and including a pump inlet and a manifold defining a pump outlet. An insulating arrangement including an insulator plate is arranged between the pushrod housing and the manifold and defines a first air gap between the cold end portion and the insulator plate and a second air gap between the insulator plate and the warm end portion.

In yet another aspect, the present disclosure describes an insulating arrangement for a cryogenic pump configured for pressurizing a cryogenic fluid, the cryogenic pump including a warm end portion adapted to not contact cryogenic fluid during operation of the pump and including one or more driving components and a cold end portion adapted to contact cryogenic fluid during operation of the pump and including a pump inlet and a pump outlet. The insulating arrangement includes an insulator plate arrangeable between the warm end portion and the cold end portion so as to define a first air gap between the cold end portion and the insulator plate and a second air gap between the insulator plate and the warm end portion.

DETAILED DESCRIPTION

Figure 1:
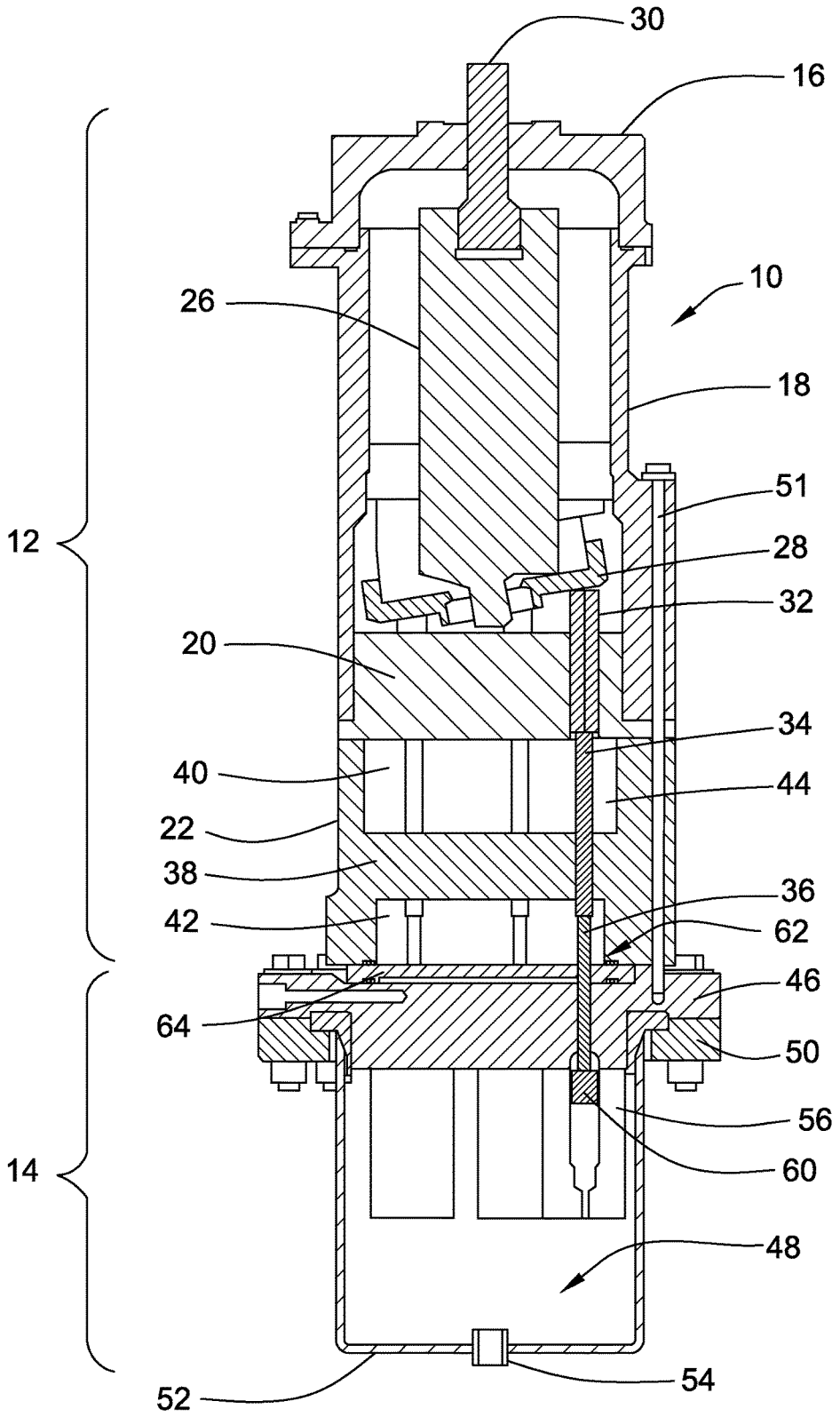
FIG. 1 is a side sectional view of an exemplary cryogenic pump according to the present disclosure.

This disclosure generally relates to a cryogenic pump 10 and, more particularly, to an insulation arrangement separating a warm end portion 12 of the pump from a cold end portion 14 of the pump. With reference to FIG. 1 of the drawings, an exemplary cryogenic pump 10 according to the present disclosure is shown. The cryogenic pump 10 of FIG. 1 may be configured to pump fluids at cryogenic temperatures, such as temperatures of less than minus 100 degrees Celsius. In one exemplary application, the cryogenic pump 10 can be configured as a pump for drawing LNG from a tank, pressurizing it, and delivering it to an engine at high pressure. LNG is normally stored at temperatures of between about minus 240 degrees F. (minus 150 degrees C.) and minus 175 degrees F. (minus 115 degrees C.) and at pressures of between about 15 and 200 psig (204 and 1477 kPa) in a cryogenic tank. The engine, for example, may be on a machine such as a large mining truck or a locomotive. The high pressure LNG from the cryogenic pump may be vaporized into a gaseous form by a heat exchanger before it is introduced into the engine. Of course, those skilled in the art will appreciate that the cryogenic pump 10 of the present disclosure is not limited to applications involving the pumping of LNG or, more particularly, engine fuel delivery systems. Instead, the cryogenic pump 10 of the present disclosure can be used in any application involving the pumping of a cryogenic liquid.

With reference to FIG. 1 of the drawings, the cryogenic pump 10 may be generally configured with a warm end portion 12 and a cold end portion 14. In the illustrated embodiment, the cold end portion 14 of the cryogenic pump 10 is the lower portion of the pump and generally includes the pump components that are intended to come into contact with the cryogenic fluid during operation of the pump including a pump inlet and a pump outlet. The warm end portion 12 of the illustrated pump is the upper portion of the pump and generally includes one or more driving components of the pump that are not intended to contact the cryogenic fluid during operation of the pump. The components in the cold end portion 14 of the cryogenic pump 10 may be constructed of materials rated for cryogenic service, while the components in the warm end portion 12 may be constructed of conventional materials.

With reference to the cross-sectional view of FIG. 1, the warm end portion 12 of the pump may include a housing cap 16, a bearing housing 18, a tappet housing 20 and a pushrod housing 22. Starting from the upper end of the cryogenic pump 10 as shown in FIG. 1, the housing cap 16 may be connected to an upper end of the bearing housing 18 while a lower end of the bearing housing 18 is connected to the tappet housing 20. The lower end of the tappet housing 20 may, in turn, be connected to the pushrod housing 22 which, in the illustrated embodiment, defines the lower end of the warm end portion 12 of the cryogenic pump 10.

As further shown in FIG. 1, a rotatable shaft 26 and a load plate 28 may be contained within the bearing housing 18. The rotatable shaft 26 may be connected at its upper end to a stub shaft 30 that protrudes outward from the housing cap 16. The stub shaft 30 may be operatively connected to any suitable prime mover capable of producing a rotary output such as, for example, an electric or hydraulic motor or a diesel or gasoline engine. The shaft 26 may be supported in the bearing housing 18 by a bearing assembly 24 that may include various bearings, including thrust bearings, for rotatably supporting the shaft 26. At the end opposite the stub shaft 30, in this case the lower end, the shaft 26 may be operatively connected to the load plate 28 so as to drive movement thereof. In the illustrated embodiment, the load plate 28 may be supported in the bearing housing 18 for wobbling movement about the center of the load plate 28. This shaft 26 may be operatively connected to the load plate 28 in such a manner that rotation of the shaft 26 drives the wobbling movement of the load plate 28. In other embodiments, the shaft 26 and the load plate 28 may be configured and supported such that rotation of the shaft drives rotary movement of the load plate.

A plurality of tappets 32 may be arranged immediately beneath with an upper end of each tappet in contact with the load plate 28. Only a single tappet 32 is visible in the cross-section of FIG. 1, however, it will be understood that additional tappets 32 may be provided. For example, the illustrated embodiment is configured so as to include five tappets 32 arranged in an annular pattern. Each of the tappets 32 may have an elongate configuration and be supported for longitudinal movement in a respective passage in the tappet housing 20. The movement of the tappets 32 may be driven by the load plate 28. More specifically, the load plate 28 may be supported at a transverse angle relative to the longitudinal axis of the pump such that wobbling movement of the load plate 28 drives reciprocal movement of the tappets 32.

A lower end of each tappet 32 may engage a corresponding upper pushrod 34 that, in turn, engages at its lower end a corresponding lower push rod 36. In the cross-sectional view of FIG. 1, a total of three upper and lower pushrod 34, 36 pairs are visible. However, it will be understood that a respective upper and lower pushrod 34, 36 pair may be provided for each tappet 32. Each upper pushrod 34 may be supported in the pushrod housing 22 for movement in the longitudinal direction of the pushrod 34 in response to a force applied at the upper end thereof by the tappet 32. To this end, each upper pushrod 34 may be received in a corresponding opening in a transverse section 38 that extends across the pushrod housing 22 and defines upper and lower cavities 40, 42. Thus, transverse section 38 acts as a pushrod guide, allowing longitudinal movement of upper pushrods 34 while limiting lateral movement. The longitudinal movement of the upper pushrods 34, in turn, applies a force on the lower pushrods 36 that drives movement of the respective lower pushrod 36 in the longitudinal direction. In this case, downward movement of each tappet 32 and upper pushrod 34 may be counter to the force of a respective spring arranged, for example, in the upper cavity 40 of the pushrod housing 22 that drives the upper pushrod 34 and tappet 32 back upward when the force applied by the load plate 28 is relieved by rotation of the plate.

Referring to FIG. 1, the cold end portion 14 of the cryogenic pump 10 may include a manifold 46 and a reservoir 48. More specifically, the manifold 46 may be arranged at the lower end of the pushrod housing 22, while the reservoir 48 may be attached to the lower side of the manifold 46. To facilitate connection between the manifold 46 and the reservoir 48, the reservoir 48 may have an annular retainer 50 at the upper end thereof that abuts against an outer portion of the lower surface of the manifold 46 and is secured thereto, for example, by fasteners. The manifold 46, in turn, may be connected to the pushrod housing 22 by one or more tie rods 51 (one is shown in FIG. 1) that extend through the bearing housing 18, the tappet housing 20 and the pushrod housing 22 and into the manifold 46.

The reservoir 48 may include an outer vacuum jacket 52 that has an opening 54 at its lower end to allow for cryogenic fluid, e.g. LNG, to enter into the reservoir 48. The reservoir 48 may further house a plurality of barrels 56 each of which defines an inlet for the cryogenic pump 10. According to one embodiment, at least a portion of the barrel 56 may be submerged in cryogenic fluid contained in the reservoir 48. Generally, as discussed further below, each barrel 56 corresponds to a respective one of the tappet and pushrod combinations. Thus, while three barrels 56 are visible in the cross-sectional view of FIG. 1, it will be understood that the cryogenic pump 10 may have any number of barrels as well as correspond tappet and pushrod combinations. For example, the illustrated embodiment is configured to have a total of five barrels 56.

Each lower pushrod 36 may extend downward through a corresponding passage through the manifold 46 and into a corresponding one of the barrels 56 where it engages with a plunger 60 arranged in the barrel 56 to form a pumping element. With this arrangement, movement of the lower pushrod 36 (as driven by the load plate 28 through the corresponding tappet 32 and upper pushrod 34) can drive movement of the plunger 60. Movement of the plunger 60, in turn, draws the cryogenic fluid into the barrel 56 and pressurizes it. The pressurized cryogenic fluid may then be directed into the manifold 46 which defines the outlet for the pressurized fluid from the cryogenic pump 10.

To help limit the transfer of heat from the warm end portion 12 of the cryogenic pump 10 to the cold end portion 14, the cryogenic pump 10 may include an insulating arrangement 62 arranged between the warm and cold end portions 12, 14 of the cryogenic pump 10. More particularly, as shown for example in FIG. 2, the insulating arrangement 62 may include an insulator plate 64 arranged between the manifold 46 and the pushrod housing 22 that defines at least one air gap between the warm and cold end portions 12, 14 of the cryogenic pump 10 that limits the contact area between the metallic components of the warm and cold end portions. For example, the insulator plate 64 may be configured to only contact the components of the cold end portion 14 of the cryogenic pump 10 in areas necessary to bear load or to assist with sealing.

Figure 2:
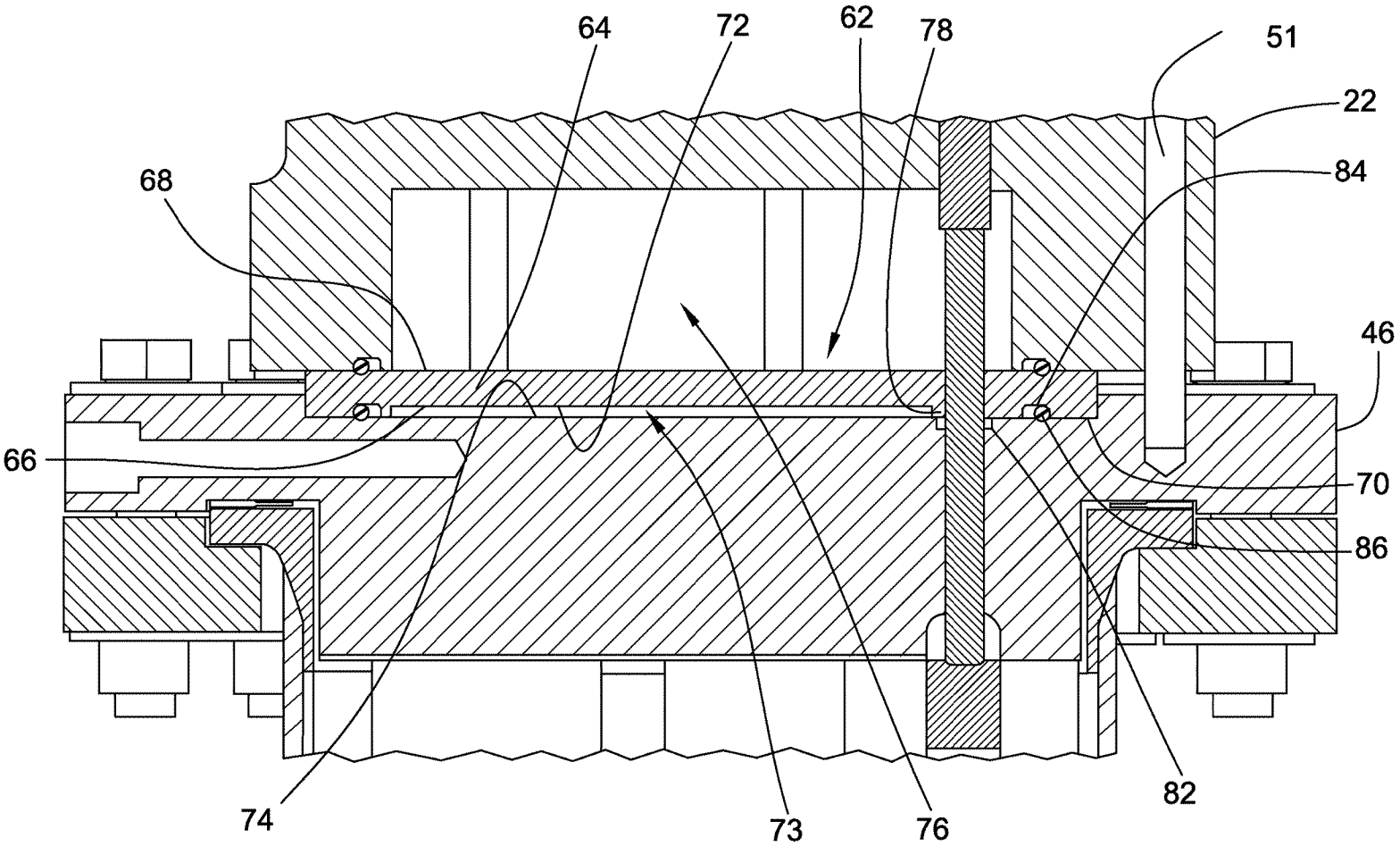
FIG. 2 is an enlarge partial side sectional view of the cryogenic pump of FIG. 1 showing the insulating arrangement.
Figure 3:
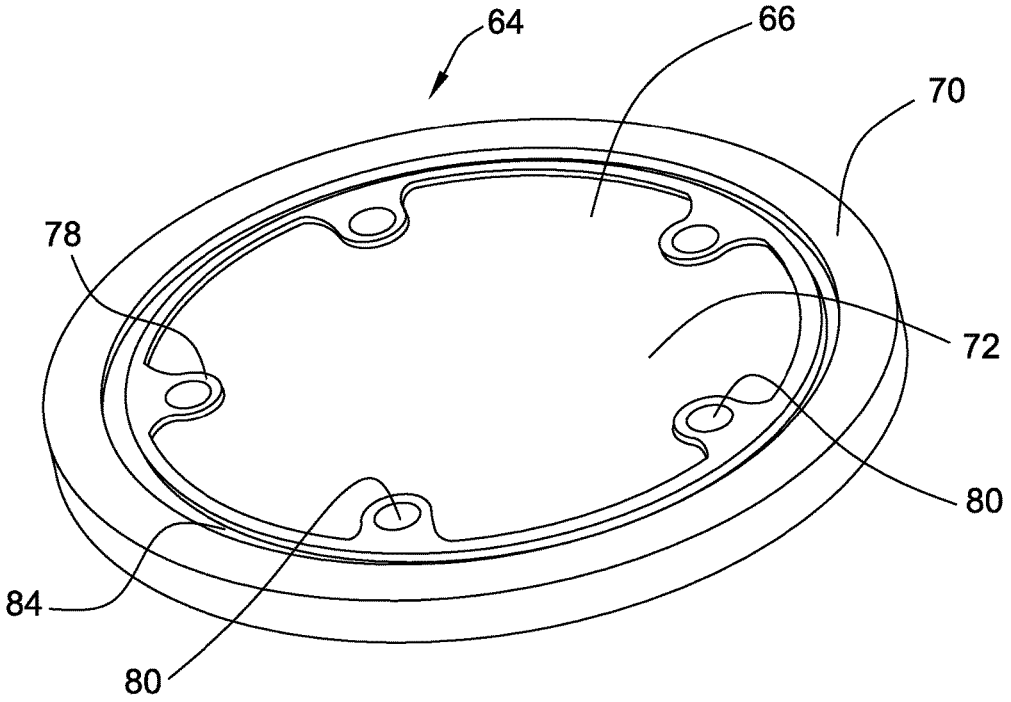
FIG. 3 is an isometric view of the insulator plate of the cryogenic pump of FIG. 1 showing the lower surface of the insulator plate.

As shown in FIGS. 2 and 3, the insulator plate 64 may have a generally disk-like configuration with a lower first side 66 that faces the manifold 46 and an upper second side 68 that faces the pushrod housing 22. In the FIG. 3 view of the insulator plate 64, the lower first side 66 of the insulator plate 64 is facing upward. With reference to FIG. 3, the lower first side 66 of the insulator plate 64 may have a raised outer portion 70 that extends around the outer circumferential edge of the plate and a recessed center portion 72 arranged radially inward of the raised outer portion. The recessed center portion 72 may define a first air gap 73 between the insulator plate 64 and the manifold 46 when the insulator plate 64 is arranged between the manifold 46 and the pushrod housing 22. In particular, as shown in FIG. 2, the raised outer portion 70 of the insulator plate 64 may contact the upper surface 74 of the manifold 46 and support the insulator plate 64 on the manifold 46 such that the lower first side 66 of the insulator plate is spaced a distance away from the upper surface 74 of the manifold 46 in the area of the recessed center portion 72 of the insulator plate. Thus, the recessed center portion 72 may define the first air gap 73 that is bounded on the lower side by the upper surface 74 of the manifold 46 and on the upper side by the recessed center portion 70 of the lower first side 66 of the insulator plate 64. According to one exemplary embodiment, the thickness of the first air gap 73 between the insulator plate 64 and the manifold 46 may be approximately 4 mm.

The insulator plate 64 may be arranged and the pushrod housing 22 may be configured so as to define a second air gap 76 between the cold and warm end portions 14, 12 of the cryogenic pump 10. In particular, the second air gap 76 may be formed by the lower cavity 42 of the pushrod housing 22 which would be cut off from the cold end portion 14 of the cryogenic pump 10 by the insulator plate 64. In such a case, the upper second side 68 of the insulator plate 64 may define a lower bound of the second air gap 76 while the upper bound is defined by the transverse section 38 of the pushrod housing 22. This second air gap 76 may provide a further barrier to heat transfer between the warm and cold end portions 12, 14 of the cryogenic pump 10. In the illustrated embodiment, the second upper side 68 of the insulator plate 64 is substantially flat, however it will be appreciated that other configurations may be used so long as the second air gap 76 is formed between the insulator plate 64 and the pushrod housing 22.

The insulator plate 64 may be mounted in the cryogenic pump 10 with an outer portion of the insulator plate sandwiched between the pushrod housing 22 and the manifold 46. In particular, as shown in FIG. 2, the upper second side 68 of the insulator plate 64 may contact a lower surface of an outer wall of the pushrod housing 22 while, as noted above, the raised outer portion 70 of the lower first side 66 of the insulator plate 64 may contact the upper surface of the manifold 46. The insulator plate 64 may be held in that position by the force applied by the one or more tie rods 51 that connect the pushrod housing 22 to the manifold 46. With this arrangement the only part of the insulator plate 64 that contacts both the pushrod housing 22 of the warm end portion 12 of the cryogenic pump 10 and the manifold 46 of the cold end portion 14 is the most radially outward portion of the insulator plate 64, the portion which also provides the support holding the insulator plate in position. By minimizing this contact area, the insulating arrangement 62 of the present disclosure can limit the heat transfer between the warm and cold end portions 12, 14 of the cryogenic pump 10.

The recessed center portion 72 in the lower first side 66 of the insulating plate 64 may include raised seal supports 78 extending around each of a plurality of openings 80 extending through the insulating plate 64 between the first and second sides. The plurality of openings 80 may be arranged in an annular pattern radially inward of the raised outer portion 70 and be configured to have extending therethrough a respective one of the lower pushrods 36 as shown in FIG. 2. One of the pushrods 36 is shown extending through one of the openings 80 in the insulator plate 64 in FIG. 2. Each of the raised seal supports 78 may provide support for a pushrod seal 82 that may sit in an annular recess in the upper surface 74 of the manifold 46 surrounding the corresponding pushrod opening in the manifold. The raised seal supports 78 may be connected by an annular raised ring that together with the raised outer portion defines an annular groove 84 within which a seal 86 may be arranged. Such a seal 86 may help prevent leakage through the area where the raised outer portion 70 of the lower first side 66 of the insulator plate 64 contacts the upper surface 74 of the manifold 46. As will appreciated by those skilled in the art, other sealing arrangements could be used for the pushrod openings in the manifold and the joint between the insulating plate and the manifold.

The provision of the first and second air gaps 73, 76 between the warm and cold end portions 12, 14 of the cryogenic pump 10 may allow the insulator plate 64 to be constructed of a more conventional, more thermally conductive material. Air has a relatively low thermal conductivity, particularly in comparison to many solid materials. As such, with the insulating arrangement of the present disclosure, materials that are considered relatively thermally conductive may be used for the insulator plate 64. For example, according to one embodiment, the insulator plate 64 may be made of stainless steel. Other metal materials also could be used such as carbon steels, aluminum and other relatively low-cost metals. An advantage of using such materials is that while they may have a relatively high thermal conductivity, they have a relatively low thermal expansion as compared to conventional insulating materials. Moreover, materials such as stainless steel and other metals may have superior strength and toughness as compared to conventional insulating materials.

INDUSTRIAL APPLICABILITY

The insulating arrangement 62 of the present disclosure may be applicable to any type of cryogenic pumps having separate cold and warm end portions. Moreover, the cryogenic pump 10 may be used in any application requiring the pumping of a cryogenic fluid. For example, the cryogenic pump 10 of the present disclosure has particular applicability to the pumping of LNG at high pressures in fuel delivery systems for vehicles such as locomotives and large mining trucks.

As noted above, the insulating arrangement 62 of the present disclosure allows for the use of relatively low cost materials with relatively higher thermal conductivities, such as stainless steel, for the insulator plate. This may allow for a significant cost savings over expensive low thermal conductivity materials such as yttria stabilized zirconia and titanium. These lower cost materials also may be much easier to machine than conventional insulating materials. Moreover, as compared to relatively expensive low thermal conductivity materials, the use of a material such as stainless steel provides the insulator plate with better mechanical properties such as lower thermal expansion and greater strength and toughness. This can allow the insulator plate to better withstand the significant thermal gradients and high mechanical stresses found in a cryogenic pump application without cracking or other failures as compared to conventional insulating materials.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A cryogenic pump configured for pressurizing a cryogenic fluid, the cryogenic pump comprising:

a warm end portion adapted to not contact cryogenic fluid during operation of the pump and including one or more driving components disposed within a housing, wherein the one or more driving components include a plurality of pushrods;

a cold end portion adapted to contact cryogenic fluid during operation of the pump and including one or more barrels, each of the one or more barrels including a pump inlet and a pump outlet, and each of the one or more barrels connected to a manifold so that the pump outlet of each of the one or more barrels is in fluid communication with a pressurized fluid outlet defined by the manifold, the manifold configured to fluidly isolate the cryogenic fluid from the warm end portion during operation; and an insulating arrangement including an insulator plate arranged between the warm end portion and the cold end portion, a first air gap being defined between the cold end portion and the insulator plate;

wherein the warm end portion includes a transverse section operatively configured as a pushrod guide, the insulator plate and the transverse section of the warm end portion defining a second air gap therebetween.

2. The cryogenic pump of claim 1 wherein the insulator plate includes a first side having a raised outer portion and a recessed center portion, the recessed center portion defining the first air gap.

3. The cryogenic pump of claim 1 wherein an outer portion of the insulator plate is sandwiched between a portion of the warm end portion and a portion of the cold end portion to support the insulator plate between warm end portion and the cold end portion, wherein the manifold and a recessed center portion of the insulator plate facing the manifold defines the first air gap.

4. The cryogenic pump of claim 2 wherein the insulator plate has a plurality of openings therethrough each of which receives a corresponding pushrod.

5. The cryogenic pump of claim 4 wherein each of the plurality of openings is surrounded by a respective raised portion on the first side of the insulator plate and each respective raised portion surrounding the openings in the insulator plate provides a support surface for a seal extending between the insulator plate and a portion of the cold end portion.

6. The cryogenic pump of claim 2 wherein the driving components include a plurality of pushrods and the warm end portion includes a pushrod housing with a transverse section that supports the pushrods and a second air gap extends between a second side of the insulator plate opposing the first side and the transverse section of the pushrod housing.

7. The cryogenic pump of claim 1 wherein the insulator plate is made of stainless steel.

8. A cryogenic pump configured for pressurizing a cryogenic fluid, the cryogenic pump comprising:

a warm end portion adapted to not contact cryogenic fluid during operation of the pump, the warm end portion including a shaft and a load plate for driving longitudinal movement of a plurality of pushrods, the plurality of pushrods being contained in a pushrod housing, the pushrod housing including a pushrod guide supporting the pushrods;

a cold end portion adapted to contact cryogenic fluid during operation of the pump and including one or more barrels, each of the one or more barrels including a pump inlet and a pump outlet, and each of the one or more barrels connected to a manifold so that the pump outlet of each of the one or more barrels is in fluid communication with a pressurized fluid outlet defined by the manifold, the manifold configured to fluidly isolate the cryogenic fluid from the warm end portion during operation; and an insulator plate disposed between a portion of the pushrod housing and a portion of the manifold, the insulator plate including a plurality of openings therethrough, each of which receives a corresponding one of the plurality of pushrods, the insulator plate further including a first side having a raised outer portion and a recessed center portion, the recessed center portion and the manifold defining a first air gap therebetween.

9. The cryogenic pump of claim 8, wherein the pushrod guide is configured as a transverse section within the pushrod housing, the transverse section, the pushrod housing, and a second side of the insulator plate opposite the first side of the insulator plate defining a second air gap.

10. The cryogenic pump of claim 8 wherein each of the plurality of openings through the insulator plate is surrounded by a respective raised portion on the first side of the insulator plate and each of the raised portions surrounding the openings in the insulator plate provides a surface for a seal extending between the insulator plate and a portion of the manifold.

* * * * *